US012569896B2

(12) United States Patent
Fürst et al.

(10) Patent No.: US 12,569,896 B2
(45) Date of Patent: Mar. 10, 2026

(54) METHOD AND INSTALLATION FOR INDUCTIVELY HEATING FLAT OBJECTS

(71) Applicants: Primetals Technologies Austria GmbH, Linz (AT); ABP Induction Systems GmbH, Dortmund (DE)

(72) Inventors: Heinz Fürst, Gallneukirchen (AT); Simon Grosseiber, Leonding (AT); Thomas Lengauer, Weißkirchen a.d. Traun (AT); Achim Thus, Rheinberg (DE); Adrej Umbrasko, Holzwickede (DE); Michael Zahedi, St. Marien (AT)

(73) Assignees: Primetals Technologies Austria GmbH (AT); ABP Induction Systems GmbH (DE)

( * ) Notice: Subject to any disclaimer, the term of this patent is extended or adjusted under 35 U.S.C. 154(b) by 350 days.

(21) Appl. No.: 18/004,573

(22) PCT Filed: Jul. 8, 2021

(86) PCT No.: PCT/EP2021/069035

§ 371 (c)(1),
(2) Date: Jan. 6, 2023

(87) PCT Pub. No.: WO2022/013066

PCT Pub. Date: Jan. 20, 2022

(65) Prior Publication Data

US 2023/0241657 A1 Aug. 3, 2023

(30) Foreign Application Priority Data

Jul. 15, 2020 (EP) ..... 20000253

(51) Int. Cl.
*B21B 37/44* (2006.01)
*B21B 1/22* (2006.01)

(52) U.S. Cl.
CPC ..... *B21B 37/44* (2013.01); *B21B 1/22* (2013.01); *B21B 2001/225* (2013.01)

(58) Field of Classification Search
CPC ..... B21B 1/22; B21B 2001/225; B21B 37/44; C21D 1/42; H05B 6/101
See application file for complete search history.

(56) References Cited

U.S. PATENT DOCUMENTS 4,315,124 A * 2/1982 Granstrom ..... H05B 6/104 348/123
4,708,325 A * 11/1987 Georges ..... H05B 6/104 266/104

(Continued)

FOREIGN PATENT DOCUMENTS

CA 2633942 A1 7/2007
CN 101346196 A 1/2009

(Continued)

OTHER PUBLICATIONS

International Search Report mailed Oct. 8, 2021 in corresponding PCT International Application No. PCT/EP2021/069035.

(Continued)

*Primary Examiner* — Edward T Tolan
(74) *Attorney, Agent, or Firm* — OSTROLENK FABER LLP

(57) ABSTRACT

A method and an installation for inductively heating flat objects that are transported in a feed direction. The installation has at least one transverse field inductor device which extends transversely to the feed direction over the width of the flat object and has a longitudinal axis running parallel to the transverse axis of the flat object. The transverse field inductor device is positioned such that the longitudinal axis extends in a vertical plane obliquely with respect to the transverse axis of the flat object. With the method it is possible to vary the distance between the flat object and the (Continued)

inductor device and thus the temperature distribution over the transverse profile of the flat object so that the flat object is heated homogeneously.

10 Claims, 4 Drawing Sheets

(56) References Cited

U.S. PATENT DOCUMENTS

| | | | | |
|---|---|---|---|---|
| 4,778,971 | A * | 10/1988 | Sakimoto | C21D 9/60 219/673 |
| 4,788,396 | A | 11/1988 | Maugein et al. | |
| 4,828,227 | A * | 5/1989 | Georges | H05B 6/365 266/104 |
| 5,245,148 | A * | 9/1993 | Mohr | H05B 6/104 219/654 |
| 5,336,868 | A | 8/1994 | Schluckebier | |
| 5,401,941 | A * | 3/1995 | Mauve | C21D 9/60 219/673 |
| 5,403,994 | A | 4/1995 | Havas et al. | |
| 6,300,608 | B2 * | 10/2001 | Inoh | H05B 6/36 148/567 |
| 6,498,328 | B2 | 12/2002 | Anderhuber et al. | |
| 6,570,141 | B2 * | 5/2003 | Ross | H05B 6/104 219/676 |
| 6,576,878 | B2 * | 6/2003 | Thorpe | H05B 6/104 219/673 |
| 7,671,307 | B2 | 3/2010 | Nikanorov et al. | |
| 8,536,498 | B2 * | 9/2013 | Hirota | H05B 6/104 219/673 |
| 8,592,735 | B2 * | 11/2013 | Hirota | H05B 6/365 219/645 |
| 9,445,460 | B2 * | 9/2016 | Lovens | H05B 6/40 |
| 10,259,030 | B2 * | 4/2019 | Mikami | B21D 22/18 |
| 10,757,764 | B2 * | 8/2020 | Fontaine | H05B 6/104 |
| 10,880,958 | B2 | 12/2020 | Umetsu et al. | |
| 11,371,115 | B2 | 6/2022 | Guastini et al. | |
| 12,090,535 | B2 * | 9/2024 | Lengauer | B21B 1/026 |
| 2007/0051152 | A1 | 3/2007 | Degenhardt et al. | |
| 2007/0193322 | A1 * | 8/2007 | Beck | B21B 37/28 72/11.7 |
| 2009/0065501 | A1 * | 3/2009 | Dickson | H05B 6/40 219/635 |
| 2017/0036257 | A1 * | 2/2017 | Sakane | B21D 37/16 |
| 2018/0092163 | A1 | 3/2018 | Pralong et al. | |
| 2019/0029080 | A1 | 1/2019 | Umetsu et al. | |
| 2023/0010580 | A1 * | 1/2023 | Thus | C21D 9/46 |

FOREIGN PATENT DOCUMENTS

| | | | |
|---|---|---|---|
| CN | 108781484 | A | 11/2018 |
| CN | 110495248 | A | 11/2019 |
| DE | 3928629 | A1 | 3/1991 |
| DE | 4234406 | A1 | 4/1994 |
| DE | 10013061 | A1 | 10/2001 |
| DE | 10312623 | A1 | 10/2004 |
| DE | 202007003450 | U1 * | 6/2007 |
| DE | 102012021028 | A1 | 5/2013 |
| EP | 0274673 | B1 | 5/1991 |
| EP | 0667731 | B1 | 6/2001 |
| EP | 1648628 | A1 | 4/2006 |
| EP | 1148762 | B1 | 10/2008 |
| EP | 3439430 | A1 | 2/2019 |
| JP | 2000-252050 | A * | 9/2000 |
| KR | 101428178 | A1 * | 8/2014 |
| WO | WO 2019/102511 | A1 | 5/2019 |

OTHER PUBLICATIONS

Office Action dated Feb. 22, 2025 in corresponding Chinese Patent Application No. 202180049452.7 and an English translation of CN Search Report.

* cited by examiner

METHOD AND INSTALLATION FOR INDUCTIVELY HEATING FLAT OBJECTS

CROSS-REFERENCE TO RELATED APPLICATIONS

The present application is a 35 U.S.C. §§ 371 national stage application of International Application No. PCT/EP2021/069035, filed Jul. 8, 2021, which claims priority to European Patent Application No. EP20000253, filed Jul. 15, 2020, the contents of which are incorporated herein by reference.

TECHNICAL FIELD

The present invention relates to a method for inductively heating flat objects transported in a feed direction, preferably a steel strip, with at least one transverse field inductor device, which extends transversely with respect to the feed direction over the width of the flat object and has a longitudinal axis running parallel to a transverse axis of the flat object. The present invention further relates to an installation with which such a method can be carried out.

Instead of using conventional gas-heated furnaces, flat objects, such as strips, sheets, and slabs, are also heated inductively. In this case, a current is induced in the flat object, thereby heating the material.

Inductive heating installations for heating flat objects have longitudinal field inductors for longitudinal field heating or transverse field inductors for transverse field heating.

In the case of longitudinal field heating, the flat object to be heated is completely surrounded by the inductor coil, with the result that the magnetic main flux is aligned in the feed direction of the flat object. The induced currents close over the workpiece cross section, the temperature distribution which is established being virtually homogeneous at a suitable frequency of the inductor current over the entire strip width of the flat object.

In the case of transverse field heating, the inductor coils do not surround the flat object but are arranged on the upper and/or lower side of the flat object to be heated. In this way, the magnetic main flux of the inductor coils is aligned perpendicularly to the surface of the flat object. However, the disadvantage with transverse field heating installations is that the temperature distribution in the flat object is usually inhomogeneous. This requires an appropriate design of the geometric dimensions and optimization of the operating parameters of a transverse field heating installation for each application.

PRIOR ART

The practice of influencing the disadvantageous inhomogeneous temperature distribution by a selective design of the inductor coils is already known. Furthermore, further solutions for the flexible setting of the temperature distribution in flat objects are known, for example the arrangement of two inductor coils transversely with respect to the flat object and two inductor coils longitudinally with respect to the flat object. The two coils extending in the longitudinal direction of the flat object can be shifted in the transverse direction of the flat object, thus enabling the temperature distribution at the lateral edges of the flat object to be set (JP 63195397).

Other solutions are described in DE 39 28 629 A1, EP 0 667 731 B1, DE 42 34 406 A1 and DE 100 13 061 A1.

DE 103 12 623 A1 relates to a transverse field heating installation having the features of the preamble of patent claim 1. In this case, the inductor device has at least two inductor layers, which are arranged one above the other parallel to the plane of the flat object and can be shifted independently of one another transversely with respect to the feed direction in order in this way to achieve flexible setting of the temperature distribution in the flat object in the transverse direction of the flat object.

Yet more solutions are described in EP 0 274 673 B, EP 1 648 628 A1 and EP 1 148 762 B1. The first-mentioned publication describes how, by adapting the coil shape, it is possible to achieve a different application of energy and thus a different increase in temperature over the width of the flat object. The publication cited second discloses the possibility of influencing the transverse temperature profile by lateral setting of transverse field induction coils, usually in the edge region. The publication cited third describes the possibility of setting the transverse temperature profile by means of movable cores.

US 20180092163 A1 discloses a heating device for an aluminum strip having a plurality of rotating rollers for magnetic heat induction. The rotating rollers are arranged in the transverse direction of the flat object. In addition, this document discloses the practice of setting a roller obliquely to the transverse axis of the flat object in a vertical plane. Since the rotating rollers with the electromagnets arranged in the rollers are significantly more complicated than non-rotating inductors, this invention deals exclusively with non-rotating transverse field inductor devices.

SUMMARY OF THE INVENTION

The underlying object of the present invention is to provide a method and an installation by means of which, in the inductive heating of flat objects, a particularly homogeneous temperature distribution over their transverse profile can be achieved.

According to the invention, this object is achieved in a method of the type indicated by the fact that each transverse field inductor device comprises at least two non-rotating conductors, which run in the transverse axis of the flat object and through which an alternating current flows in series; and that the longitudinal axis of the transverse field inductor device is positioned obliquely to the transverse axis of the flat object in a vertical plane.

The solution according to the invention is thus based on the concept of varying the distance between the transverse field inductor device and the upper side or the lower side of the flat object, as required, over the transverse profile of the flat object by oblique setting of the transverse field inductor device, with the result that the flat object is heated to different degrees over its transverse profile. It can be assumed here that the heating is less, the greater the distance between the flat object and the transverse field inductor device. This is noticeable particularly in the transverse end regions of the flat object, as a result of which, by means of the oblique setting of the inductor device, a large distance is provided in one end region and a small distance is provided in the other end region, ensuring that the end regions are heated to different degrees here. If the other end region is to be heated to a greater degree, a smaller distance is produced in this region by oblique setting than in the other end region. By changing the inclination, both transverse end regions can thus be variably heated.

As a result of the non-rotating conductors running in the transverse direction of the flat object, the transverse field inductor device forms at least one, preferably a plurality of, "windings" arranged in series, ensuring that the magnetic induction and the inductive heating power are significantly higher than in the case of a single current-carrying conductor. The arrangement of the conductors in the transverse direction of the flat object also ensures that even wide flat objects, for example having a width of between 900 and 2800 mm, can be heated uniformly by the transverse field inductor device.

The oblique setting of the transverse field inductor device carried out according to the invention thus varies the distance from the flat object, enabling the temperature distribution of the flat object during heating to be optimized by means of different distances between the inductor device and the flat object. The variation of the distance is preferably carried out by means of an open-loop or closed-loop control device.

This is because the electric current induced in the material depends on the distance from the coil. In the case of the transverse field induction method described here, this dependency can be represented by the following formula $$P=P0*e^{-kx}$$

where P0 is the induced current at a minimum distance from the material, x is the distance and k is a characteristic coefficient for the system geometry.

As a further development of the invention, the procedure is preferably such that a temperature of the flat object is measured upstream and/or downstream of the transverse field inductor device in the feed direction, and oblique setting of the transverse field inductor device is carried out in accordance therewith. In this case, in particular, a temperature profile of the flat object is measured over the width thereof. Particularly in the case in which temperature irregularities due to inhomogeneities and other causes are measured in the flat object, corresponding evening out or compensation during the heating process can then be carried out by means of the oblique setting. In this case, for example, the temperature measuring device transmits a corresponding signal to an open-loop or closed-loop control device, which brings about a corresponding movement of the inductor device (oblique setting of the latter).

Thus, for example, the open-loop or closed-loop control device calculates a corresponding temperature and position model which represents the required application of thermal energy over the width of the flat object, and the inductor device is set to the calculated and required inclination in order to compensate for the temperature deviation.

In particular, the procedure here can be such that, depending on the measured temperature of the flat object or on the temperature profile, the required application of energy to the transverse field inductor device is determined, and this is then used to calculate the oblique setting of the transverse field inductor device in the transverse direction of the flat object. In this way, accurate temperature setting can then take place over the transverse profile of the flat object. In addition to the setting of the application of energy by an alternating current source, the angle of obliquity of the inductor device is therefore set.

According to the invention, an upper and/or a lower transverse field inductor device can be set obliquely. In this case, the oblique setting of the transverse field inductor device or transverse field inductor devices can be accomplished hydraulically, pneumatically or electromechanically.

As a further development of the invention, the transverse field inductor device is shifted transversely with respect to the feed direction (i.e. the longitudinal axis of the flat object). This can preferably be done in both directions. It is thereby possible, in addition to the oblique setting, to even out temperature irregularities or compensate temperature deviations, thus ensuring that ultimately a homogeneous temperature profile of the flat object is obtained at the end of the heating process. In this case, the transverse field inductor device is shifted transversely with respect to the feed direction or longitudinal axis of the flat object in accordance with the temperature measurement of the flat object upstream of the transverse field inductor device in the feed direction.

In addition, it is possible to shift one transverse field inductor device relative to another transverse field inductor device transversely with respect to the feed direction. The temperature profiles can thereby be set variably on the upper and lower sides of the flat object.

According to the invention, oblique setting and transverse positioning of the transverse field inductor device is carried out by the open-loop/closed-loop control device, in particular in accordance with the temperature measurement of the flat object. In other words, the transverse field inductor device is shifted in the transverse direction relative to the flat object and is set obliquely relative to the flat object transverse axis in order to achieve the desired temperature setting.

In particular, a multiplicity of temperature measurements, in particular in intermediate positions, can be carried out on the flat object to allow a flexible response to temperature deviations. According to the invention, adaptations to the respective conditions can be made in order to achieve a particularly high accuracy with respect to the temperature setting.

In a further development of the invention, wherein the flat object is hot rolled after the inductive heating and a flatness and/or a profile of the hot-rolled flat object are/is measured, oblique setting and/or transverse positioning of one or more transverse field inductor devices are/is carried out in accordance with the measured flatness and/or profile.

This embodiment is based on the recognition that a temperature distribution of the flat object which is not uniform in the transverse direction has an unfavorable effect on the flatness and/or the profile of the hot-rolled flat object during and after hot rolling. Provision is therefore made to vary the oblique setting and/or the transverse positioning of one or more transverse field inductor devices based on the flatness and/or the profile of the hot-rolled flat object. This improves the geometric properties of the hot-rolled flat object.

The present invention furthermore relates to an installation for inductively heating flat objects which can be transported in a feed direction with at least one transverse field inductor device, which extends transversely with respect to the feed direction over the width of the flat object and has a longitudinal axis running parallel to a transverse axis of the flat object.

The installation designed in accordance with the invention is characterized in that each transverse field inductor device comprises at least two non-rotating conductors, which run in a transverse axis of the flat object and through which an alternating current flows in series, and in that the installation has at least one, preferably two, particularly preferably four, positioning devices for the transverse field inductor device, thus enabling the longitudinal axis of the transverse field inductor device to be positioned obliquely to the transverse axis of the flat object in a vertical plane.

In this case, the transverse field inductor device is preferably mounted in a frame or stand of the installation in such a way that it can be raised or lowered at one or the other transverse end in order to achieve the desired oblique setting. In particular, the positioning device preferably comprises, in each transverse end region of the transverse field inductor device, a positioning device for raising or lowering the respective transverse end of the transverse field inductor device.

In a further development, the installation furthermore comprises a temperature measuring device for the flat object upstream and/or downstream of the transverse field inductor device. In addition, an open-loop or closed-loop control device is provided which serves to control the positioning device in order to raise or lower the inductor device in a manner dependent on the temperature measuring device. In this case, the temperature measuring device measures, in particular, a temperature profile in the transverse direction of the flat object.

The installation designed in accordance with the invention preferably functions in such a way that the open-loop or closed-loop control device provided determines the power applied to the transverse field inductor device in accordance with the measured temperature and correspondingly controls an alternating current source for supplying power. Furthermore, in accordance therewith, the positioning device is controlled in order to set the inductor device obliquely, thus enabling an optimum temperature distribution to be achieved by varying the power supply and the distance over the transverse profile of the flat object.

The installation preferably has an upper and lower transverse field inductor device, one or both of which can be controlled.

As mentioned, positioning devices are provided for the oblique setting of the inductor device, each being designed as a hydraulic, pneumatic and/or electromechanical actuating element.

In a further development, the installation according to the invention has a device for the transverse shifting of the inductor device. In this case, the inductor device is moved in the transverse direction relative to the flat object, with the result that, in addition to the oblique setting of the inductor device, there is a further possibility of variation for heating the transverse profile of the flat object. In this case, for example, the stand of the installation, which carries the inductor device, is shifted transversely as a whole relative to the flat object. The effects resulting from the oblique setting and the transverse position are thereby superimposed in order to achieve the desired temperature distribution.

It is particularly advantageous if, in an installation having an upper and a lower transverse field inductor device, one or more drive devices for the transverse shifting of the transverse field inductor devices relative to one another are present.

The temperature measuring device provided according to the invention can have a multiplicity of sensors in order in this way to be able to carry out particularly accurate temperature measurement, thereby enabling the accuracy of the heating of the flat material over its transverse profile to be increased.

In an advantageous embodiment, at least one hot-rolling stand for hot rolling the flat objects and a measuring unit for measuring the flatness and/or profile of the hot-rolled flat objects are arranged downstream of the installation for inductive heating in the feed direction, wherein the open-loop or closed-loop control device can carry out oblique setting and/or transverse positioning of a transverse field inductor device in accordance with the flatness and/or profile.

According to the invention, an improvement in the accuracy and homogeneity of the transverse temperature profile of the flat object is thus achieved. Furthermore, homogeneous surfaces of the flat object and homogeneous material properties over the width thereof are achieved. The end product has a high flat object profile accuracy. Furthermore, an improvement in the homogeneity of the wear of the working rolls and thus an extended service life of the installation are achieved.

BRIEF DESCRIPTION OF THE DRAWINGS

The above-described properties, features and advantages of this invention and the manner in which these are achieved will become more clearly and distinctly comprehensible in conjunction with the following description of an exemplary embodiment, which is explained in greater detail in conjunction with the drawings. In the drawings.

DESCRIPTION OF THE EMBODIMENTS

Figure 1:
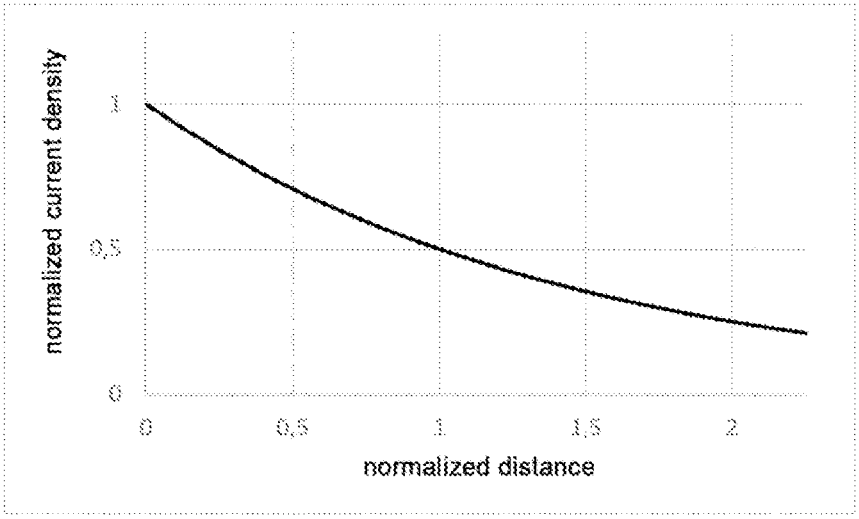
FIG. 1 shows a diagram depicting the induced current density as a function of the distance between the transverse field inductor device and the material of the flat object.

FIG. 1 shows a diagram depicting the induced current density as a function of the distance between the coil of a transverse field inductor device and the flat object. In this case, the normalized current density is indicated on the ordinate, while the normalized distance is shown on the abscissa. It can clearly be seen that the current density decreases with increasing distance.

Figure 2:
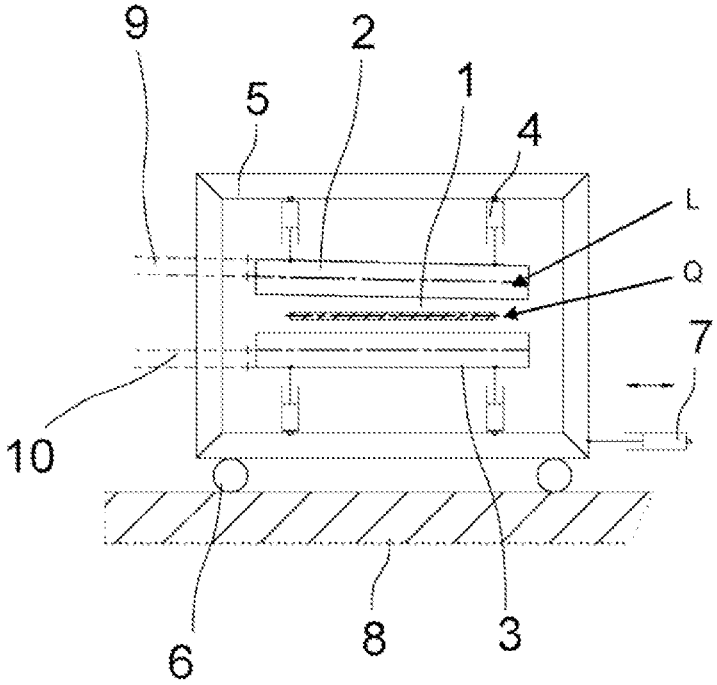
FIG. 2 shows a schematic cross section through a first embodiment of an installation for inductively heating flat objects.

The installation shown schematically in FIG. 2 for inductively heating flat objects which can be transported in a feed direction has an upper transverse field inductor device 2 and a lower transverse field inductor device 3, which are illustrated here only schematically in each case as bars. The two devices 2, 3 have induction coils, which are supplied with alternating current via electric cables 9, 10 in order to generate corresponding eddy currents that cause heating of the flat object 1 arranged between the two transverse field inductor devices 2, 3. Here, the flat object 1 is a steel strip to be heated, which passes through the installation in a direction perpendicular to the plane of the drawing.

The two transverse field inductor devices 2, 3 are wider than the flat object 1 and are each mounted on a frame 5 of the installation so as to be vertically adjustable by means of two positioning devices 4 designed as hydraulic cylinders or electric linear drives. The installation can be moved in the transverse direction, i.e. perpendicularly to the longitudinal axis of the flat object 1, by means of rollers 6 on a base 8 provided with rails. A corresponding drive device is illustrated at 7.

The installation is provided with a positioning device for the two transverse field inductor devices 2, 3, which comprises the positioning devices 4 illustrated. Each inductor device 2, 3 is therefore provided with two positioning devices 4, which bring about raising or lowering of the inductor devices 2, 3 in their transverse end regions. In the embodiment illustrated in FIG. 1, the lower inductor device 3 extends parallel to the flat object 1 and at a distance therefrom, while the upper inductor device 2 is arranged obliquely thereto. The oblique setting of inductor device 2 is achieved by actuating the positioning device 4 illustrated on the left in FIG. 1, which has raised inductor device 2 somewhat in this region, with the result that its distance from the flat object 1 increases.

This oblique setting or raising of inductor device 2 has the purpose of increasing the distance of the inductor device 2 from the flat object 1 and thereby varying the heating of the latter in this region compared to the heating in the other transverse end region. As a result of the greater distance, therefore, the flat object is heated less in this end region than in the opposite end region, thus making it possible, for example, to achieve a greater uniformity of the temperature profile in the transverse direction of the flat object 1.

In particular, the installation functions in such a way that a measuring device (not shown here) is arranged upstream of the passage through the installation, said device measuring a temperature profile in the transverse direction of the flat object 1. The corresponding signal from the measuring device is fed to a control device (not shown), which uses this to determine a temperature and position model and controls, on the one hand, the alternating current source for the two inductor devices 2, 3 and, on the other hand, the two positioning devices 4 of the upper inductor device 2. The two inductor devices 2, 3 and the positioning devices 4 are therefore controlled in such a way that a homogeneous temperature distribution results over the transverse profile of the flat object 1.

Figure 3:
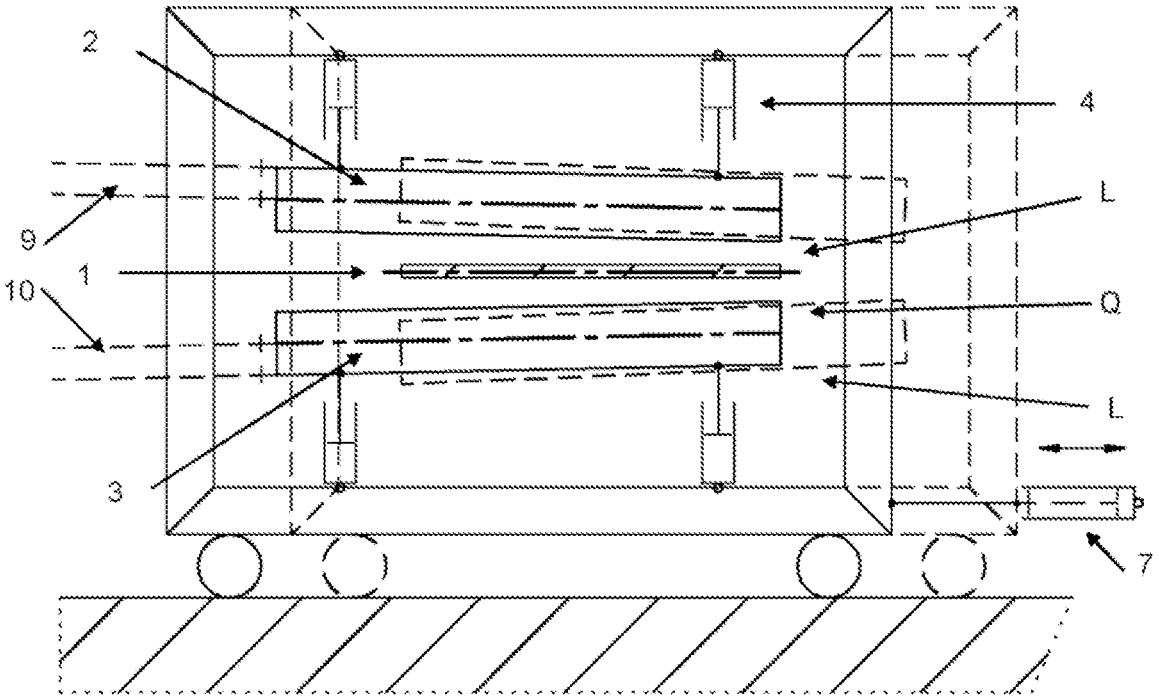
FIG. 3 shows a schematic cross section through a second embodiment of an installation for inductively heating flat objects.

FIG. 3 shows an embodiment of an installation in which, in addition to the oblique setting of the inductor devices 2, 3, shifting of the installation in the transverse direction relative to the flat object 1 is possible. The two positions of the inductor devices 2, 3, which are shifted to the right, are illustrated in dotted lines in the figure. For this purpose, the housing of the installation is shifted to the right in the figure by means of rollers 6 arranged on the underside of the associated frame 5, the shifted position being illustrated by dashed lines. After the shift, the flat object 1 is therefore no longer situated centrally with respect to the two inductor devices 2, 3 but is shifted to the left relative to these.

Moreover, the installation is provided with a device for the oblique setting of the two inductor devices 2, 3. In this case, both the upper and the lower inductor device 2, 3 have been moved somewhat upward and downward by means of the positioning devices 4 illustrated on the left-hand side of the figure, resulting in a corresponding oblique setting. In the left-hand transverse end region of the flat object 1, therefore, the distance from the respective inductor device 2, 3 is greater than in the right-hand transverse end region thereof.

In this embodiment too, a measuring device (not shown) is provided upstream of the passage through the installation, said measuring device measuring a transverse temperature profile of the flat object 1 and transmitting a corresponding signal to an associated control device (likewise not shown). This control device then controls both the alternating current source for the application of energy to the two inductor devices 2, 3 and the positioning device for the oblique setting of the inductor devices 2, 3 and the device for shifting them transversely. The position and temperature model generated by the control device is therefore implemented by actuating the three above-mentioned devices, resulting in a substantially homogeneous transverse temperature profile for the flat object 1 at the outlet of the installation.

Figure 4:
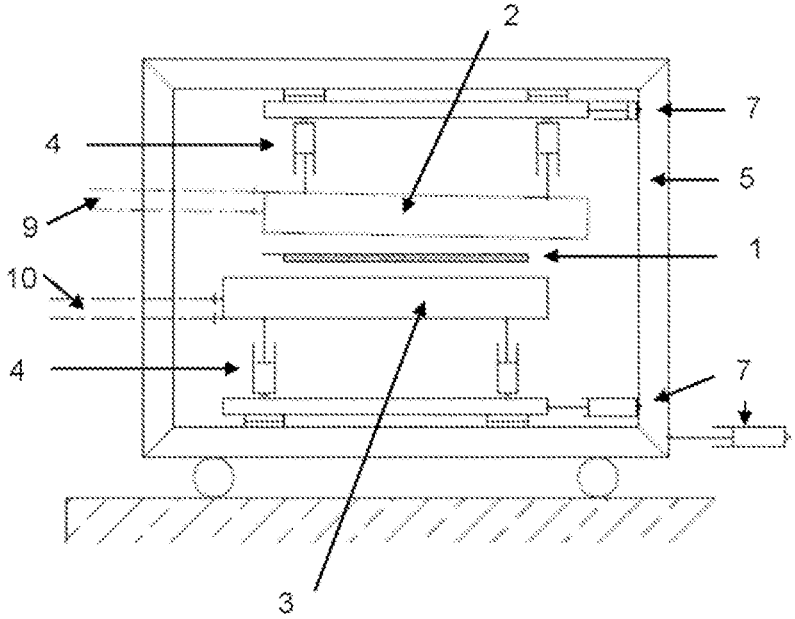
FIG. 4 shows a schematic cross section through a third embodiment of an installation for inductively heating flat objects.

FIG. 4 illustrates an installation for inductively heating flat objects 1. In contrast to FIG. 4, the upper and lower transverse field inductor devices 2, 3 can be moved independently of one another in the transverse direction of the flat object by means of drive devices 7. The temperature profile can thereby be set independently from the upper and lower sides of the flat object 1. In addition, it is possible to shift the entire frame 5 by means of a further drive device 7. This can be advantageous in order to be able to move the induction modules quickly away from the flat object 1 in the event of a cobble. As illustrated, the upper and lower transverse field inductor devices 2, 3 can be both set obliquely separately with respect to the transverse axis of the flat object 1 and shifted separately in the transverse direction. It is, of course, possible to provide only the transverse shifting of a transverse field inductor device. In this case too, a relative shift of the transverse field inductor devices can be achieved.

Figure 5:
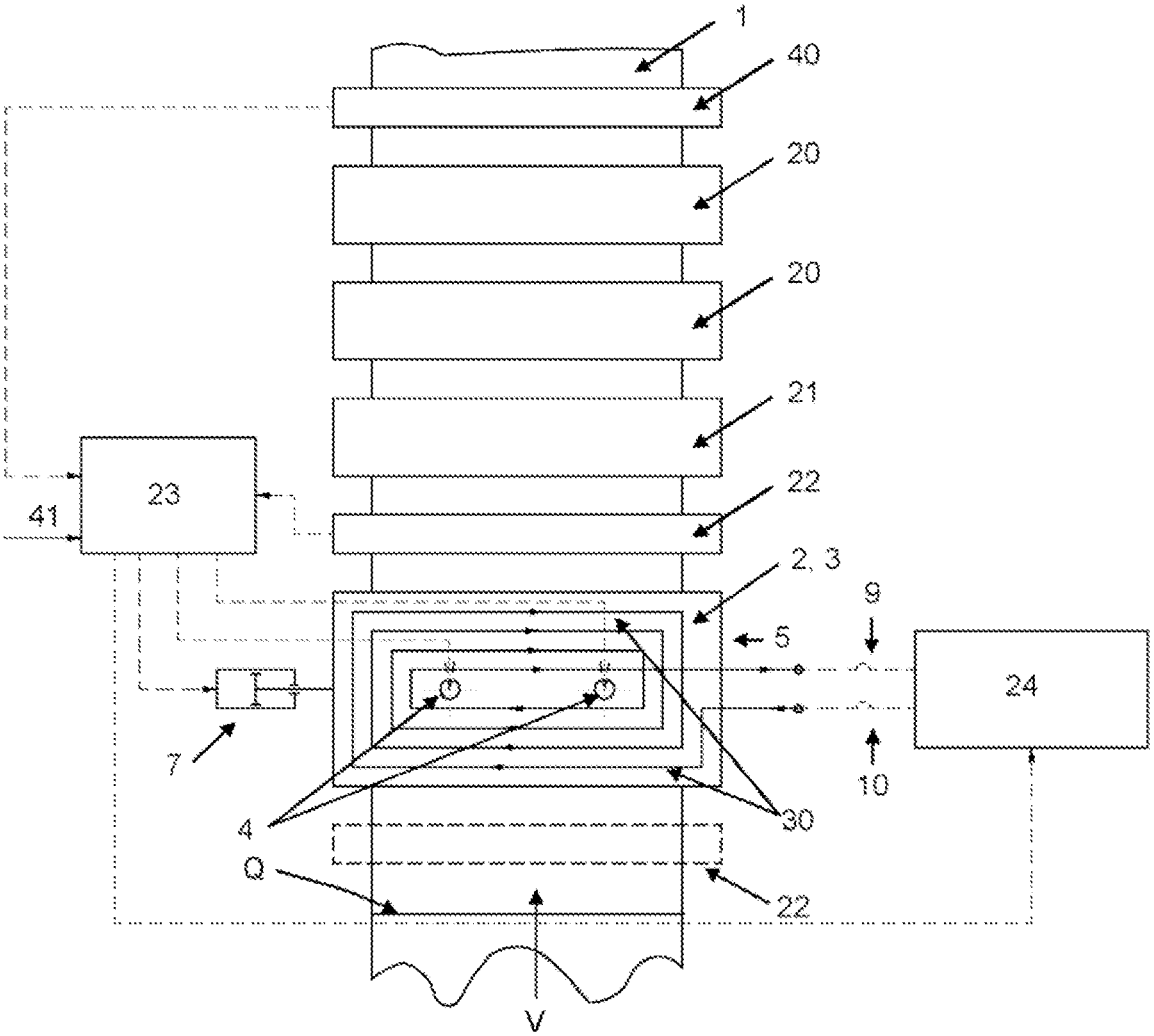
FIG. 5 shows a plan view of an installation for inductively heating flat objects in a hot-rolling mill.

FIG. 5 shows schematically a plan view of an installation for inductive heating with a single induction module having an upper and lower transverse field inductor device 2, 3, only the upper transverse field inductor device 2 being visible. Each inductor device 2, 3 has eight conductors 30, which are aligned in the transverse direction Q of the flat object 1 and, for example, forms four windings. Of course, it is possible to provide more than four, e.g. 20, windings. The inductor devices 2, 3 can be positioned obliquely to the transverse axis of the flat object by means of two positioning devices 4 each. Oblique setting is carried out by an open-loop or closed-loop control device 23, which calculates the oblique setting in accordance with a temperature profile of the flat object 1 (see the temperature measuring device 22 upstream or downstream of the induction module), a setpoint value for the profile and/or flatness 41 and the actual value for the profile and/or flatness of the hot-rolled flat object (see the measuring unit 40). The open-loop or closed-loop device 23 is connected to the positioning devices 4 for oblique setting, the drive device 7 for the transverse shifting of the frame 5 and the alternating current source 24. By means of the alternating current source 24, it is possible to set the current intensity and optionally also the frequency of the alternating current flowing through the conductors 30. After the flat object has been heated, the flat object is descaled by the descaling device 21 and then hot rolled in succession by a plurality of hot-rolling stands 20.

Figure 6:
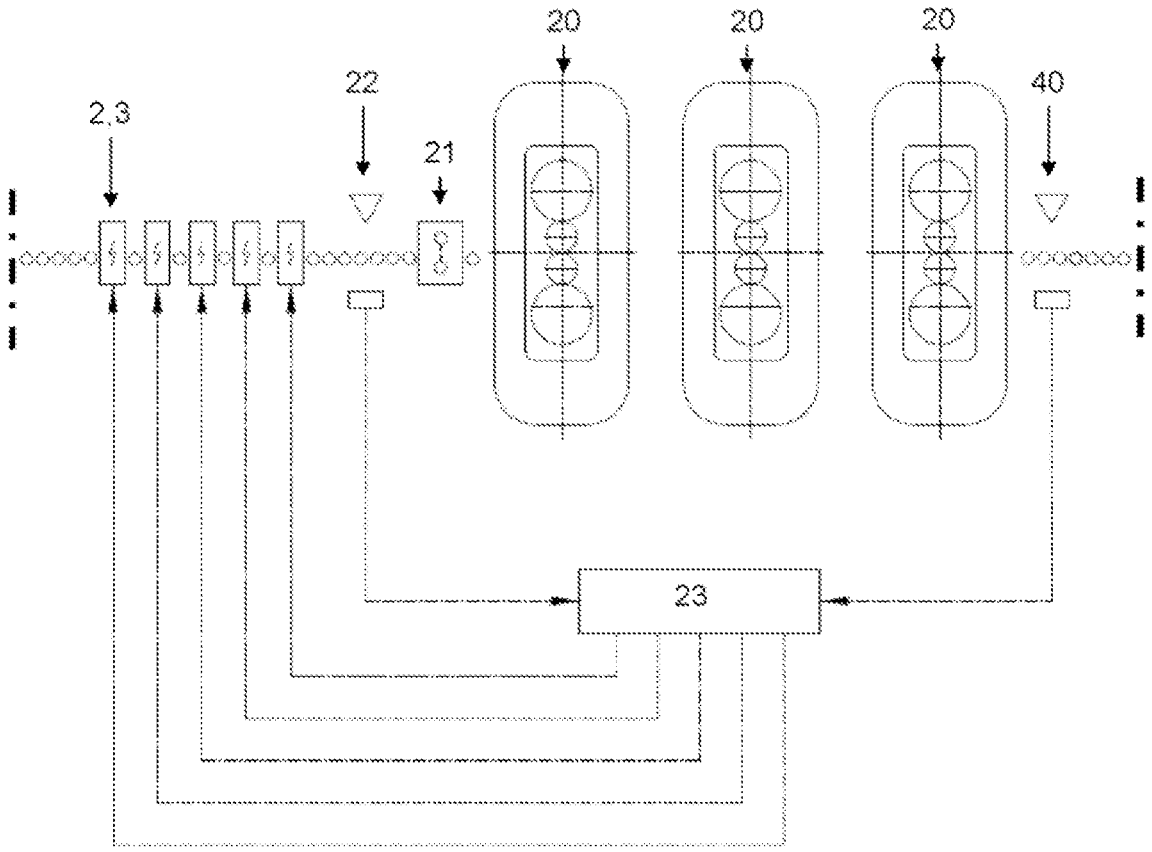
FIG. 6 shows a diagram of an installation for inductively heating flat objects in a hot-rolling mill.

Finally, FIG. 6 shows schematically a front view of an installation for inductive heating with five induction modules 2, 3, a temperature measuring device 22 for measuring a temperature profile, a descaling device 21, three hot-rolling stands 20 and a measuring unit 40 for profile and/or flatness. In this case, an open-loop or closed-loop control device 23 sets the oblique setting and, if appropriate, also a transverse shift of the transverse field inductor devices 2, 3 in accordance with the measured profile and/or flatness and with the temperature profile. The hot-rolling stands 20 can be an intermediate or finishing train in a combined casting/rolling installation in which a hot-rolled finished strip is produced from molten steel, preferably in continuous operation.

Although the invention has been illustrated and described more specifically in detail by means of the preferred exemplary embodiments, the invention is not restricted by the examples disclosed, and other variations can be derived therefrom by a person skilled in the art without exceeding the scope of protection of the invention.

LIST OF REFERENCE SIGNS

1 flat object
2 upper transverse field inductor device
3 lower transverse field inductor device
4 positioning device
5 frame
6 roller
7 drive device
8 base
9, 10 electric cable
20 hot-rolling stand
21 descaling device
22 temperature measuring device
23 open-loop or closed-loop control device
24 alternating current source
30 conductor
40 measuring unit for profile and flatness
41 setpoint value for profile and flatness
L longitudinal axis of the transverse field inductor device
Q transverse axis of the flat object
V feed direction of the flat object

The invention claimed is:

1. A method for inductively heating a flat object transported in a feed direction (V) with a transverse field inductor device, which extends transversely with respect to the feed direction (V) over the width of the flat object and has a longitudinal axis running parallel to a transverse axis (Q) of the flat object, and another transverse field inductor device, which extends transversely with respect to the feed direction (V) over the width of the flat object and has a longitudinal axis running parallel to the transverse axis (Q) of the flat object, wherein the transverse field inductor device comprises at least two conductors, which are not rotatable about longitudinal axes thereof and run in the transverse axis (Q) of the flat object and through which an alternating current flows in series, the transverse field inductor device and the another transverse field inductor device being arranged on opposite sides of the flat object; the method comprising:

transporting the flat object in the feed direction;

positioning the transverse field inductor device relative to the flat object and relative to the another transverse field inductor device so that a longitudinal axis (L) of the transverse field inductor device is oriented obliquely to the transverse axis (Q) of the flat object in a vertical plane; and inductively heating the flat object with the transverse field inductor device while the transverse field inductor device is oriented obliquely to the transverse axis (Q) of the flat object in the vertical plane.

2. The method as claimed in claim 1, wherein a temperature of the flat object is measured upstream and/or downstream of the transverse field inductor device in the feed direction (V), and oblique setting of the transverse field inductor device is carried out in accordance therewith.

3. The method as claimed in claim 2, wherein a temperature profile is measured over the width of the flat object.

4. The method as claimed in claim 2, wherein the power applied to the transverse field inductor device is determined in accordance with the measured temperature or the measured temperature profile and is set by an alternating current source.

5. The method as claimed in claim 1, wherein the oblique setting of the transverse field inductor device is carried out hydraulically, pneumatically or electromechanically.

6. The method as claimed in claim 1, wherein the at least one transverse field inductor device is shifted transversely with respect to the feed direction (V).

7. The method as claimed in claim 6, wherein the transverse field inductor device is shifted transversely with respect to the feed direction (V) relative to the another transverse field inductor device.

8. The method as claimed in claim 6, wherein the transverse field inductor device is shifted transversely with respect to the feed direction (V) in accordance with the temperature measurement of the flat object upstream and/or downstream of the transverse field inductor device.

9. The method as claimed in claim 2, wherein oblique setting and transverse positioning of the transverse field inductor device are carried out in accordance with the temperature measurement of the flat object upstream and/or downstream of the transverse field inductor device in the feed direction (V).

10. The method as claimed in claim 1, wherein the flat object is hot rolled after the inductive heating and a flatness and/or a profile of the hot-rolled flat object are/is measured, and wherein oblique setting and/or transverse positioning of a transverse field inductor device are/is carried out in accordance with the measured flatness and/or profile.

* * * * *